US005825263A

United States Patent [19]

Falt

[11] Patent Number: 5,825,263

[45] Date of Patent: Oct. 20, 1998

[54] LOW RADIATION BALANCED MICROSTRIP BANDPASS FILTER

[75] Inventor: Christopher Edgar Falt, Nepean, Canada

[73] Assignee: Northern Telecom Limited, Montreal, Canada

[21] Appl. No.: 730,006

[22] Filed: Oct. 11, 1996

[51] Int. Cl.[6] ..... H01P 1/203

[52] U.S. Cl. ..... 333/204; 333/219

[58] Field of Search ..... 333/202, 204, 333/205, 219, 5, 26, 238

[56] References Cited

U.S. PATENT DOCUMENTS

| | | | |
|---|---|---|---|
| 3,605,045 | 9/1971 | Ramsbotham, Jr. | 333/204 |
| 3,753,167 | 8/1973 | Cohn | 333/204 X |
| 4,701,727 | 10/1987 | Wong | 333/204 |
| 5,017,897 | 5/1991 | Ooi et al. | 333/204 |
| 5,027,088 | 6/1991 | Shimizu et al. | 333/1 |
| 5,164,690 | 11/1992 | Yeh et al. | 333/204 |
| 5,334,961 | 8/1994 | Shirai et al. | 333/219 X |
| 5,361,050 | 11/1994 | Einbinder | 333/204 |
| 5,404,119 | 4/1995 | Kim | 333/204 |
| 5,640,134 | 6/1997 | Ralph | 333/204 X |

FOREIGN PATENT DOCUMENTS

| | | | |
|---|---|---|---|
| 1 229 659 | 12/1966 | Germany . | |
| 58-129802 | 8/1983 | Japan | 333/204 |
| 0148405 | 8/1984 | Japan | 333/26 |
| 62-278801 | 12/1987 | Japan . | |
| 6-268409 | 9/1994 | Japan | 333/204 |
| 1474763 | 4/1989 | U.S.S.R. | 333/204 |

OTHER PUBLICATIONS

Simons et al., "Double–Shot Fin–Line Structure for Millimeter Wave Application", Proc. of the IEEE, vol. 67, No. 8, pp. 1159, 1160, Aug. 1979.

English Abstract for Fed. Rep. Germany Patent 1,229,659, Dec. 1966.

R.R. Romanofsky, et al., "An Experimental Investigation of Microstrip Properties on Soft Substrates from 2 to 40 GHz" 1985, pp. 675–678, IEEE MTT–S Digest.

Fang–Lih Lin, et al., "Coplanar Waveguide Bandpass Filter A Ribbon–Of–Brick Design" Jul. 1995, pp. 1589–1595, IEEE Transactions on Microwave Theory and Techniques vol. 43, No. 7.

John W. Bandler, et al., "Microstrip Filter Design Using Direct EM Field Simulation", Jul. 1994, pp. 1353–1359, IEEE Transactions on Microwave Theory and Techniques, vol. 42, No. 7.

P.B. Katehi, et al., "Microstrip Filter Design Including Dispersion Effects and Radiation Losses", 1986, pp. 687–690, IEEE MTT–S Digest.

K.C. Gupta, et al., Microstrip Lines I: Quasi–Static Analysis, Dispersion Models, and Measurements, 2nd Edition 1996, pp. 425–435, Microstrip Lines and Slotlines.

P.B. Katehi, "Radiatioj Losses in MM–Wave Open Microstrip Filters", 1987, pp. 137–152, Electromagnetics.

Morikazu Sagawa, et al., Miniaturized Hairpin Resonator Filters and Their Application to Receiver Front–End MIC's, Dec. 1989, pp. 1991–1997, IEEE Transactions on Microwave Theory and Techniques, vol. 37, No. 12.

Jesse Sheinwald, MMIC Compatible Bandpass Filter Design: A Survey of Applicable Techniques, Mar. 1994, pp. 26–41, Microwave Journal.

(List continued on next page.)

*Primary Examiner*—Seungsook Ham

[57] ABSTRACT

A low-radiation balanced microstrip bandpass filter is provided. A series of microstrip segments are arranged on the surface of a substrate. The degree of coupling between adjacent pairs of segments is determined by the length of overlap between them. By always having pairs of segments, a very small far field radiation is achieved.

19 Claims, 14 Drawing Sheets

OTHER PUBLICATIONS

N. I. Dib et al., "Coplanar Waveguide Discontinuities for P–I–N Diode Switches and Filter Applications", MTT–S International Microwave Symposium Digest, vol. 1, May (1990), pp. 399–402.

I. O. Vardiambasis et al., "Hybrid Wave Propagation in Circularly Shielded Microslot Fines", IEEE Transactions on Microwave Theory and techniques, vol. 43, No. 8, Aug. 1995, pp. 1960–1966.

J. S. McLean et al., "Analysis of a New Configuration of Coplanar Stripline", IEEE Transactions on Microwave Theory and Techniques, vol. 40, No. 4, Apr. (1992), pp. 772–774.

S. G. Pintzos, "Full–Wave Spectral–Domain Analysis of Coplanar Strips", IEEE Transactions on Microwave Theory, vol. 39, No. 2, Feb. (1991), pp. 239–246.

Pertti K. Ikalainen, et al., Narrow–Band Microstrip Bandpass Filters with Low Radiation Losses for Millimeter–Wave Applications, Mar. 1988, pp. 514–521, IEEE Transactions on Microwave Theory and techniques, vol. 36, No. 3.

Seymour B. Cohn, Parallel–Coupled Transmission–Line–Resonator Filters, Apr. 1958, pp. 223–232, IRE Transactions on Microwave Theory and Techniques.

M. trant, et al., Wideband Bandpass Filters Employing Broadside–Coupled Microstrip Lines for MIC and MMIC Applications, Apr. 1994, pp. 210–225, Microwave Journal.

LOW RADIATION BALANCED MICROSTRIP BANDPASS FILTER

FIELD OF THE INVENTION

The invention relates to microstrip bandpass filters, and in particular to a low-radiation balanced microstrip bandpass filter.

BACKGROUND OF THE INVENTION

Microstrip filters are filters constructed with coupled microstrip resonators. Microstrip bandpass filters may be used in transceivers for wireless systems, for example, and are typically designed with centre frequencies in the range of 1–60 GHz. Most radio systems needing modulation also require one or more bandpass filters. If a radio component such as a receiver, transmitter or transceiver is implemented using microstrip technology to interconnect its various components, then a microstrip filter is the best way to integrate with the rest of the components any bandpass filters required because the microstrip filter can be made during the same set of process steps as those used to make the interconnections between the components of the receiver. A more expensive alternative to an integrated microstrip filter is a filter which uses additional discrete components or a different substrate which may have to be packaged.

In a microstrip filter, microstrip resonators are arranged on the surface of a dielectric substrate, the substrate having a conductive ground plane beneath it. Conventional microstrip filters have a series of filter sections connected together, each section consisting of two parallel microstrip segments which overlap along a portion of their lengths. The frequency response of the filter is determined by the degree of coupling between the segments forming each section, this being determined by the perpendicular distance between the parallel segments.

In a bandpass filter, it is usually desirable to have a flat passband, with a steep roll-off outside the passband. It is also desirable to minimize the loss of the filter. Conventional microstrip bandpass filters can have excessive radiation losses at millimeter-wave frequencies. For example, it has been shown in a paper by P. B. Katehi, entitled "Radiation Losses in MM-wave Open Microstrip Filters," Electromagnetics, vol. 7, no. 2, p. 137–152, 1987, that some existing designs can radiate more that 80 per cent of the power going into the filter. A further problem is that the radiation is not uniform across the passband resulting in a sloped passband response. To overcome these problems, a shielded microstrip or stripline design is often used instead, but this adds to the cost and complicates the integration of other components such as patch antennae. In one approach to reducing radiation with conventional designs, microstrip bandpass filters were implemented using minimum width microstrip lines but this only reduced the radiation loss by about 12%.

SUMMARY OF THE INVENTION

It is an object of the invention to provide a microstrip bandpass filter which has an improved level of radiation loss compared with conventional designs.

In order to significantly reduce the radiation from an unshielded microstrip filter and the resulting loss and passband slope, the invention provides a low-radiation balanced microstrip filter. The currents and potentials along the filter are balanced and in close proximity with the result that the far field radiation is small in comparison with that of a single ended microstrip design.

According to a first broad aspect, the invention provides a microstrip bandpass filter having a centre frequency comprising a dielectric substrate; a ground plane on a first surface of the substrate; N pairs of parallel microstrip resonant segments where N is an integer≧2 including a first pair of microstrip segments and a last pair of microstrip segments, the parallel microstrip segments of a given pair being substantially coextensive, each pair located a spaced distance from the first surface, the N pairs of microstrip segments arranged in sequence lengthwise with each pair of segments coupled to any adjacent pairs of microstrip segments; input means for coupling an input line to the first pair of microstrip segments; and output means for coupling an output line to the last pair of microstrip segments.

According to a second broad aspect, the invention provides a CPW (coplanar waveguide) bandpass filter having a centre frequency comprising a dielectric substrate having a surface; N pairs of parallel balanced resonant CPW conductor segments where N is an integer≧2 including a first pair of CPW conductor segments and a last pair of CPW conductor segments, each pair located on the surface, the N pairs of CPW segments each being coextensive and arranged in sequence lengthwise with each pair of segments coupled to any adjacent pairs of CPW segments; ground regions on either side of the CPW conductor segments; input means for coupling an input line to the first pair of CPW conductor segments; and output means for coupling an output line to the last pair of CPW conductor segments.

According to a third broad aspect, the invention provides a slotline bandpass filter having a centre frequency comprising a dielectric substrate having a surface; a conductive plane on the surface with N pairs of parallel balanced resonant slots therein where N is an integer≧2 including a first pair of slots and a last pair of slots, the N pairs of parallel slots each being coextensive and arranged in sequence lengthwise with each pair of slots coupled to any adjacent pairs of slots; input means for coupling an input line to the first pair of slots; and output means for coupling an output line to the last pair of slots.

BRIEF DESCRIPTION OF THE DRAWINGS

Preferred embodiments of the invention will now be described with reference to the attached drawings in which.

DETAILED DESCRIPTION OF THE PREFERRED EMBODIMENTS

Figure 1:
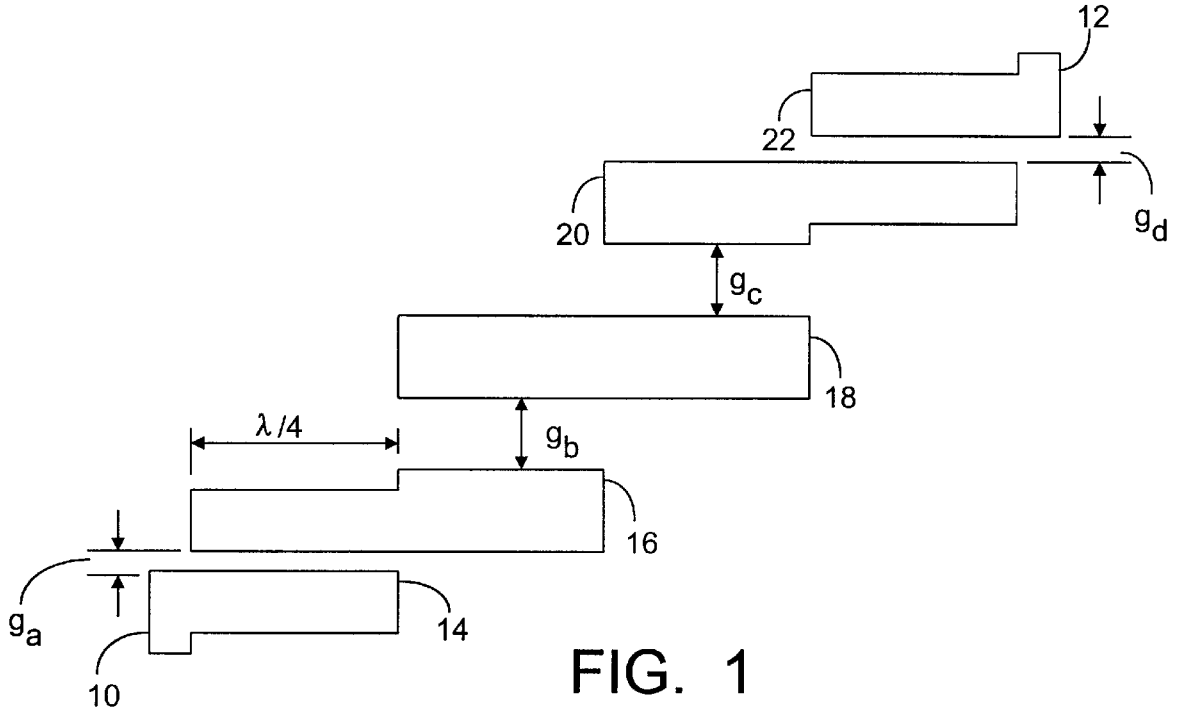
FIG. 1 PRIOR ART
FIG. 1 is a plan view of a prior art microstrip bandpass filter.

FIG. 1 depicts a plan view of a typical prior art microstrip bandpass filter having two ports 10,12 and a plurality of microstrips 14,16,18,20,22. The microstrips are located on one surface of a dielectric substrate (not shown) and a ground plane is located on the other surface of the dielectric substrate. Each of the microstrips 14 and 22 is λ/4 long and each of the microstrips 16, 18 and 20 is λ/2 long, where λ is the wavelength at the desired centre frequency of the bandpass filter. Each microstrip overlaps adjacent microstrips along a distance of λ/4. The gaps $g_a$,$g_b$,$g_c$,$g_d$ between adjacent microstrips determine the degree of coupling between adjacent microstrips and also determine the filter characteristics. The filter is made up of four sections each of which consists of two microstrips with an overlap of λ/4 located a predetermined distance apart. With conventional designs, the bandpass filter is made symmetrical with respect to the two ports 10, 12. To achieve this, $g_a=g_d$ and $g_b=g_c$.

Figure 2:
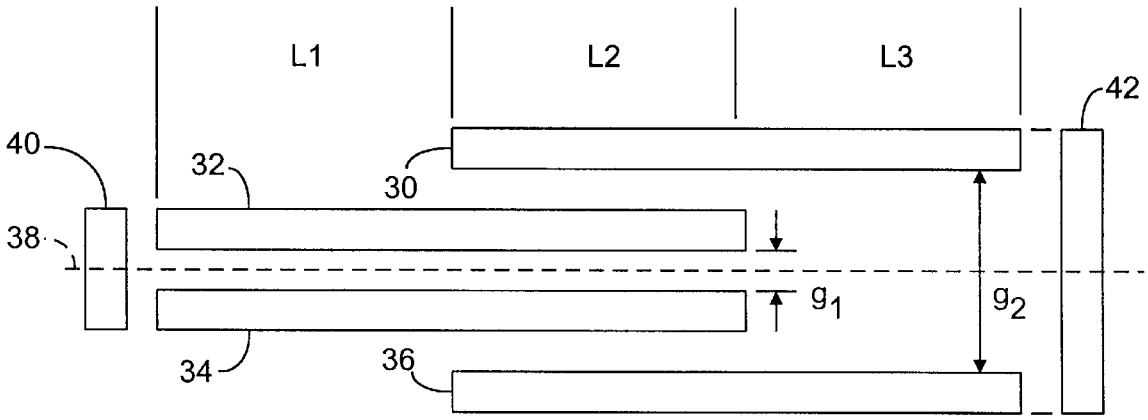
FIG. 2 is a plan view of a section of a balanced microstrip bandpass filter according to the invention.

FIG. 2 illustrates a plan view of an example of one section of a balanced microstrip filter according to the invention. Shown is a first pair of parallel microstrip segments 30,36 and a second pair of parallel microstrip segments 32,34, the two pairs of segments located between a first differential port 40 and a second differential port 42. As before, the microstrip segments are located on one surface of a dielectric substrate (not shown) and a ground plane is located on the other surface of the substrate. The filter section is symmetrical about dotted line 38; thus the pair of segments 30,36 have the same length, and the pair of segments 32,34 have the same length. As discussed below, a complete filter is a combination of several filter sections like the one depicted in FIG. 2. The length of each segment is nominally λ/4 where λ is the wavelength of the desired centre frequency for the filter. When multiple filter sections are placed side by side, adjacent segments of length λ/4 combine to form segments of length λ/2, resulting in the filter having segments of length λ/4 on either end, and length λ/2 for all the other segments. The length L2 is the length of the coupling overlap region between the pair of segments 32,34 and the pair 30,36. This length L2 determines the coupling between adjacent segments. The transmission/reflection characteristics of the filter section may be summarized by the scattering parameters $S_{ij}$. $S_{ij}$ is the ratio of the wave magnitude and phase at port i to that of the wave incident on port j, where port 1 is the input to the section, and port 2 is the output of the section. The lengths L1 and L3 are set so that the phase of $S_{21}$ which is the phase shift at the output of the filter section, is −90° at the center frequency, and the phases of $S_{11}$ and $S_{22}$ are 180° at the center frequency of the filter. In the illustrated embodiment, there is a very small gap $g_1$ between segments 32, 34. In order to allow for segments 32, 34 to be sandwiched between segments 30, 36 along a coupling overlap region L2, there is a larger gap $g_2$ between segments 30,36. Alternatively, the second pair of segments could be made to have a smaller gap, the first pair having a larger gap, so that the second pair is sandwiched between the first pair.

Figure 3A:
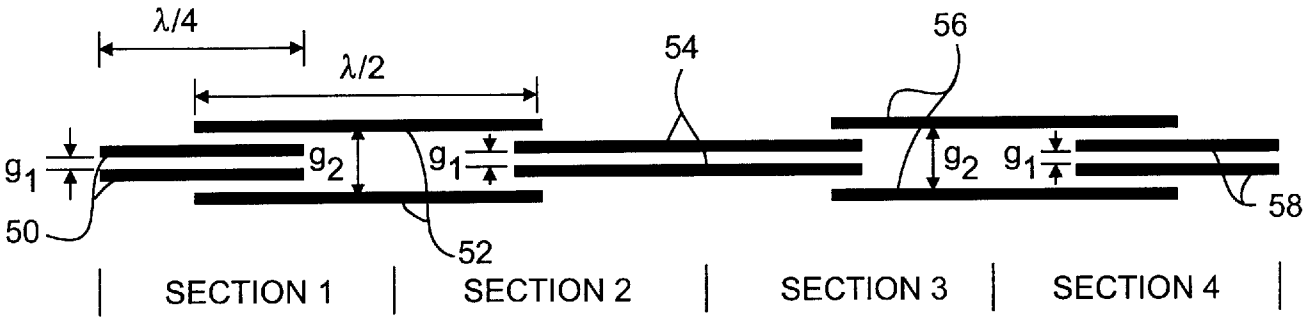
FIG. 3*a* is a plan view of a balanced microstrip bandpass filter constructed with four filter sections each similar to the filter section of FIG. 2.

A complete bandpass filter consists of several filter sections similar to the one illustrated in FIG. 2. An example of a three pole or four section Chebychev-I filter (equiripple in the pass band) realization using filter sections according to the invention is shown in FIG. 3*a*, in which four filter sections have been labeled Section 1 through Section 4. Shown are five pairs of microstrip segments 50,52,54,56,58. The first and last pairs 50,58 preferably have a length of λ/4 while the three intermediate pairs 52,54,56 preferably have a length of λ/2. The number of intermediate pairs may be defined as N where N is an integer preferably two or greater. The intermediate pairs 52,54,56 are resonators, which in a properly designed filter, will resonate at or very near the frequency of the bandpass filter. Each pair of segments has a coupling overlap region with any adjacent pairs, there being four coupling overlap regions in all. The length of the overlap region in each section corresponds to the distance L2 of FIG. 2 and is usually different for each section. The distance or gap between the two segments in each pair is preferably as small as possible since this leads to a tighter electrical coupling between the two segments, and the more tightly coupled the two segments the less radiation loss there will be. In the illustrated embodiment, this is achieved by making the distance between the two segments of each pair alternately increase and decrease. Thus, pairs 50,54,58 have a very small distance $g_1$ between them, while pairs 52,56 have a slightly larger distance $g_2$ between them to allow for the coupling overlap regions. It is preferred that the resonator pair with the highest Q have a minimum gap between them. Each resonator has its own individual frequency response and an associated Q which is a defined as $Q=f_0/(f_2-f_1)$ where $f_0$ is the centre frequency of the response, and $f_1$ and $f_2$ are the points in the response where the power is 3 dB below that at the centre frequency. In the embodiment illustrated in FIG. 3*a*, resonator pair 54 has the highest Q, and thus has a minimum gap. For the N=3 filter illustrated, the input and output pairs 50,58 can also have a gap equal to the narrowest gap but this is of secondary importance to the highest Q section having the narrowest gap.

When multiple filter sections are combined as illustrated in FIG. 3*a*, the result is three pairs of λ/2 resonators 52,54,56, and two pairs of λ/4 lines 50,58 coupling to the first and last pairs of resonators. These lengths may be considered nominal in the sense that various other physical effects may result in a preferred length for a given microstrip segment which is different from either λ/2 or λ/4. For the pairs of resonators 52,54,56, the resonators need to be the proper length for resonance at the desired centre frequency. In the case of open circuit microstrip lines such as illustrated in FIG. 3*a*, there is a fringing capacitance at the ends of the resonators, so the actual resonant length is a little less than $\lambda/2$. A line which is open circuit at one end and short circuit at the other will be resonant at ¾ $\lambda$. The lines could be terminated with an arbitrary impedance at each end causing the resonant length to vary again.

The propagation velocity, c, or the effective dielectric constant $\epsilon_{eff}=(c_0/c)_2$ where $c_0$ is speed of light in a vacuum, varies with the transmission line geometry, substrate thickness, line width, gap between segments in a pair, and the metal thickness above the top surface of the substrate. Unlike a conventional filter section, the physical geometry is different at either end of a filter section. In the case of a microstrip filter, these physical parameters are all constant with the exception of the gap. In the example of FIG. 3*a*, the gap between segment pairs alternates between $g_1$ and $g_2$. The propagation wavelength $\lambda$ at the centre frequency is defined by $\lambda=c/f_0$ and since c varies with the physical geometry as discussed above, $\lambda$ also varies. Due to this difference in the physical geometry and more particularly because $\lambda$ varies, in order for the reflection phase to be the same at both ends of a filter section, the lengths L1 and L3 (shown in FIG. 2) must be different. Once the other physical parameters are fixed, a given filter section is defined by the three variables L1, L2, and L3. These should be selected such that the electrical length is 90° at the centre frequency, and the reflection phase is the same at either end, usually 180°. How the lengths L1, L2, and L3 are determined in order to create a filter with the desired frequency response is discussed in detail further below.

The purpose of the two sets of $\lambda/4$ segments 50,58, is to couple the source of the signal to be filtered to the first and last pairs of resonators 52,56. The length of these segments is significant to the magnitude of the coupling. Depending on the difference between the resonator impedance from the interconnect impedance, the end segments may have different lengths.

Figure 4:
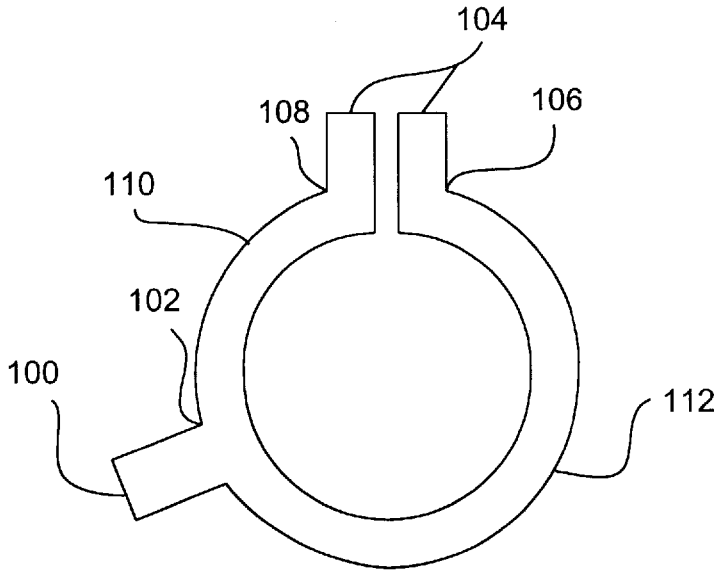
FIG. 4 is a plan view of a microstrip balun.

The bandpass filter illustrated in FIG. 3*a* has a differential or balanced input and a differential or balanced output and is suitable for connection to components which have differential inputs and/or outputs. To drive the filter from a single ended input component such as a single microstrip a microstrip to balanced microstrip transition, also known as a balun, is required. FIG. 4 illustrates a balun which can be used to implement such a transition. The balun has an input consisting of "T" junction 102 for connection to the single ended microstrip 100 and the balun has an output consisting of a pair of corners 106,108 for connection to the balanced microstrip 104 which leads to the first filter section (not shown). The balun further consists of two curved transition sections 110,112 which are ¼ and ¾ wavelengths long respectively forming a circle. Note that in the illustration the input and output are not at an angle of 90° to each other because the widths of the single ended microstrip and balanced microstrips contribute very little to the length of the transition sections. The radius of the ring and the angle between input and output may be optimized to minimize both reflection and common mode signal. Preferably, if the single ended transmission line 100 has an impedance R, the balanced line 104 has an impedance equal to 2R, and the lines 110,112 forming a circle have an impedance equal to $R\sqrt{2}$.

Balanced microstrip bandpass filters are designed to have the same frequency response as conventional transmission line filters having the same ideal filter transfer function. This may be a Chebychev-I or Butterworth response, for example. In S. B. Cohn, "Parallel-Coupled Transmission-Line-Resonator Filters," IRE Transactions on Microwave Theory and Techniques., Vol. MTT-6, No. 2, April, 1958, Cohn's formulas provide a means for computing from the overall filter transfer function the even and odd mode impedances for each conventional filter section and the frequency response of an ideal filter section. Thus for an N pole transfer function, Cohn's formulas yield N+1 individual even mode impedances, odd mode impedances, and filter section frequency responses. If the balanced line filter sections have the same characteristic impedance as the system interconnect, then they can be individually designed to match the response of the equivalent section of a conventional filter. Typically though, the balanced line filter will be designed using a characteristic impedance for the filter sections which is different from that of the system interconnect. Given this impedance, the even and odd mode impedances for each section that give the same filter response (as the conventional filter section with matched impedance at the system interconnect) can be determined using an equivalent circuit simulator with an optimizer. In either case, the N+1 filter section frequency responses of each filter section are used for the balanced line filter design.

Given the even and odd mode impedances, and the frequency response for each section, these must be converted into physical balanced microstrip filter sections as illustrated in FIG. 2. In each filter section, once the parameters such as strip width, substrate thickness and material etc. have been fixed, there are three variables, namely L1, L2, L3, which may be used to obtain the desired even and odd mode impedances and frequency response. Equivalent circuit models of the balanced filter section of FIG. 2 are not readily available, but the design can be made using an optimizer to control a moment method simulator such as Zeland software's IE3D.

Figure 5:
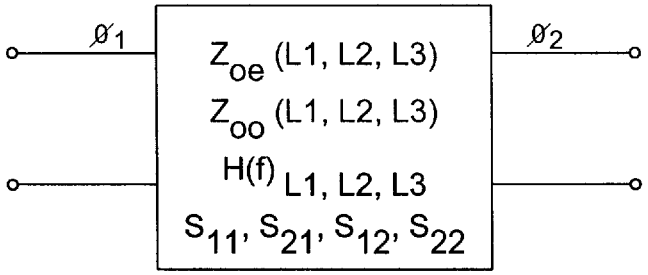
FIG. 5 is a block diagram of one filter section.
Figure 6:
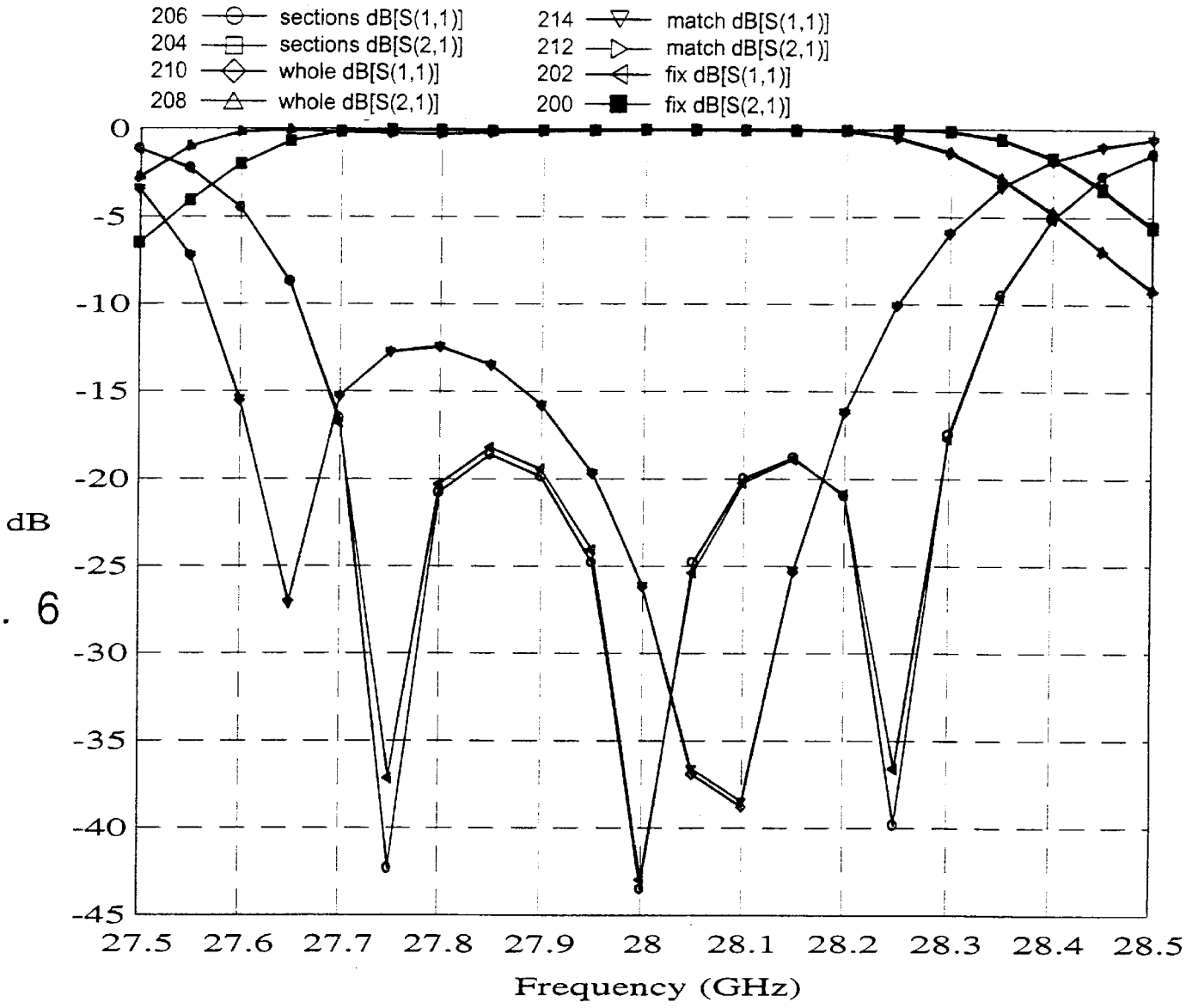
FIG. 6 is a set of plots of balanced filter design responses.

For the purpose of design, each section may be modeled with the schematic shown in FIG. 5. Each section has an ideal even mode impedance $Z_{oe}$, and an odd mode impedance $Z_{oo}$ and a frequency response summarized by the four scattering parameters $S_{11}$,$S_{12}$,$S_{21}$, and $S_{22}$, all of which are functions of L1, L2, L3. $S_{21}$ represents the frequency response at the output, and $S_{11}$represents the reflection frequency response. $\phi_1$and $\phi_2$are the phase delays introduced by the physical length of the microstrip segments. The optimizer is able to match the center frequency characteristics of each section given the three variables L1, L2, and L3 and a reasonable starting point. This technique has not been applied to optimize an entire filter at once, being limited to application to individual filter sections. A problem with moment method simulators is they typically use port extensions to ensure that a representative signal mode is launched at the point of the intended port. These extensions are removed from the simulation results by "de-embedding" but this will introduce a small phase error because the exact modes on the port extensions are not known. When the simulated responses of sections that were optimized individually are connected together, the response is very similar to the design response. However, the overall simulated response of the sections physically connected together results in a degraded response with the poles shifted around. An example of this is shown in FIG. 6 in which the response of individually simulated section responses are connected together is shown in curves 204, 206, which show the scattering parameters $S_{21}$ and $S_{11}$ respectively. This is very close to the intended response (not shown) which is determined directly from the desired filter transfer function. Curves 208, 210 show the response of the sections connected together and resimulated. One can see that the poles have shifted around by looking at the curves for $S_{11}$.

Once the three variables L1, L2, L3 have been determined for each filter section individually, the following procedure is used to tune up the whole filter at once:

1) Connect the filter sections in an equivalent circuit simulator having an optimizer with variable delay lines between each section and at the ports. The nominal filter impedance is used as the impedance of the delay lines;
2) Optimize the set of variable delay lines to match the whole filter response to determine the de-embedding phase error;
3) Estimate the length corrections required for each filter section and at the ports based on the $\epsilon_{eff}$ of the balanced line and re-simulate the whole filter;
4) Optimize again to the new whole filter response to determine the error in the length correction;
5) Interpolate between the two solutions to determine the actual length correction. A linear interpolation has been found to yield very good results with a single iteration, but in some cases, an additional iteration may be required.

Referring again to FIG. 6, the response of the filter after optimization process (step 2 above) has been carried out is plotted in curves 212, 214. Curves 200. 202 show the response of the whole filter simulated together with the length corrections made to account for the de-embedding phase error. It can been seen that those curves match very well with the response plotted in curves 204, 206 which is very close to the intended design response.

Figure 3B:
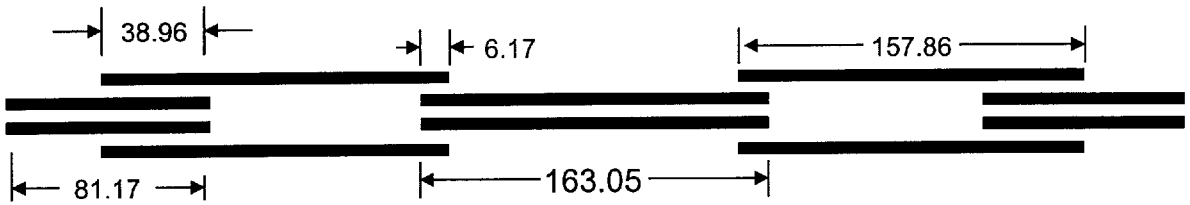
FIG. 3*b* is a plan view of the bandpass filter of FIG. 3*a* including exemplary dimensions in mils.

The results in shown FIG. 6 are for a design as illustrated in FIG. 3*b*, which shows the filter of FIG. 3*a* with exemplary dimensions indicated. The results are simulated with a 10 mil thick, $\epsilon_r$=2.2 substrate at 28 GHz, with 5 mil wide lines and spaces, referenced to a 100 Ω balanced line or differential 50 Ω lines.

Figure 7:
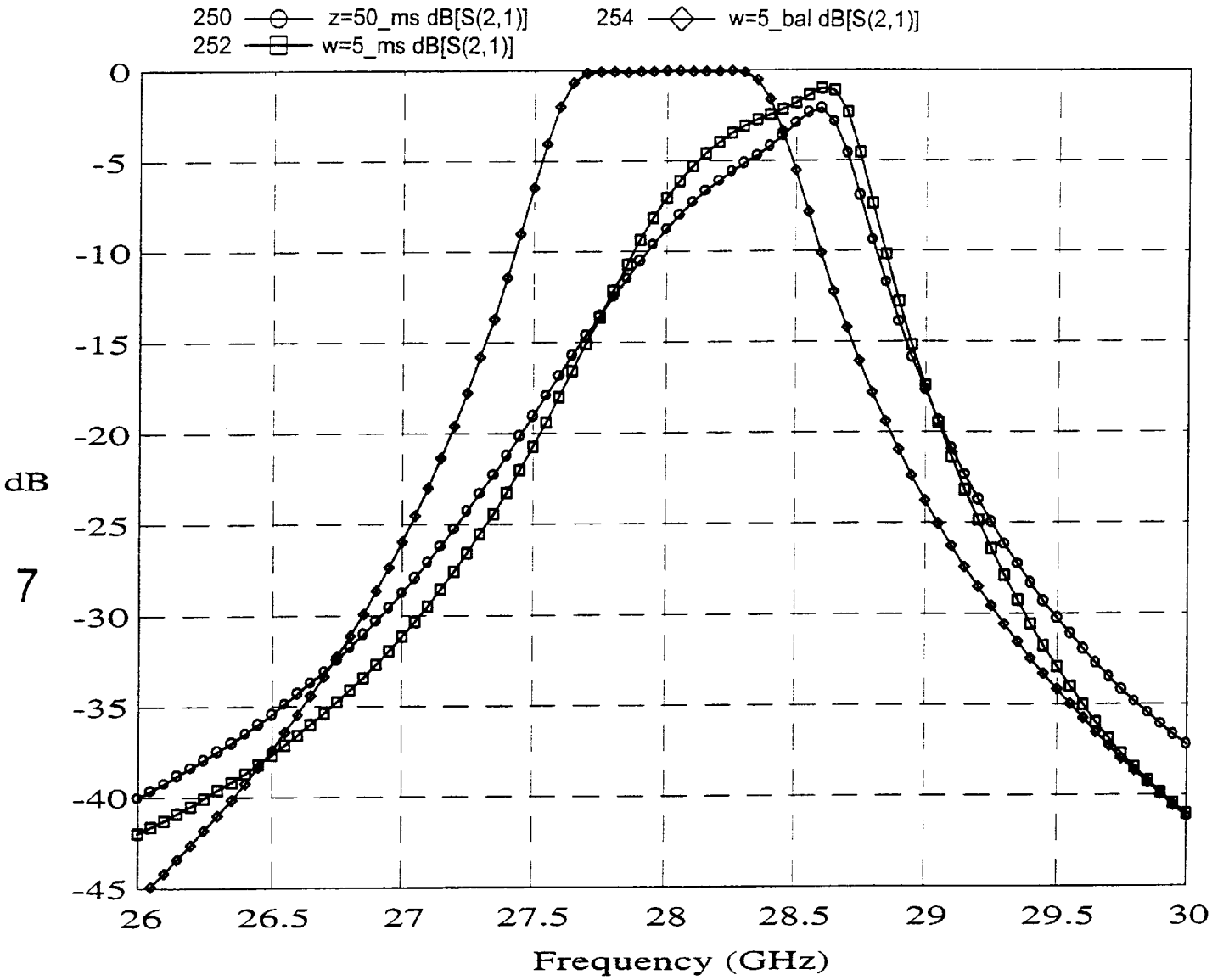
FIG. 7 is a plot comparing the frequency response of two conventional microstrip bandpass filters with that of a microstrip filter according to the invention.

For comparison, in FIG. 7, the simulated responses of a conventional 50 Ω microstrip filter designed using published formulas (curve 250), a minimum line width but otherwise conventional microstrip filter (curve 252), and the balanced microstrip filter exemplified above in FIG. 3*b* (curve 254) are shown. Each was simulated using the same materials without conductor or substrate losses, and was designed to have the same frequency response. The 50 Ω microstrip filter has a peak simulated radiation loss of 6.0 dB. The minimum line width filter response 252 has a slightly improved peak simulated radiation loss of 5.0 dB. The balanced microstrip filter response 254 has a much improved peak simulated radiation loss of 0.10 dB. The non-uniform loss of the conventional microstrip filters also degrades the frequency responses 250, 252 away from having flat passbands, while the low radiation balanced design has a very flat response 254 in the passband. A center frequency error in the response 254 of the balanced filter can be seen in the responses plotted in FIG. 7. This is an artifact of the moment method simulation of the balanced filter and is a function of the discretization or gridding of the filter. Once the offset is known, the filter can be redesigned to accommodate the offset.

The minimum simulated insertion losses including typical conductor and dielectric losses for the filters in the above comparison are 4.4 dB for the 50 Ω microstrip filter, 4.1 dB for the 5 mil wide microstrip filter, and 0.8 dB for the balanced line filter. Wider lines in the balanced line filter will increase the radiation loss to a small extent, but the conductor loss can be substantially improved. The limit will typically be determined by the amount of coupling required in the first and last sections and the minimum gap of the manufacturing process.

Figure 8:
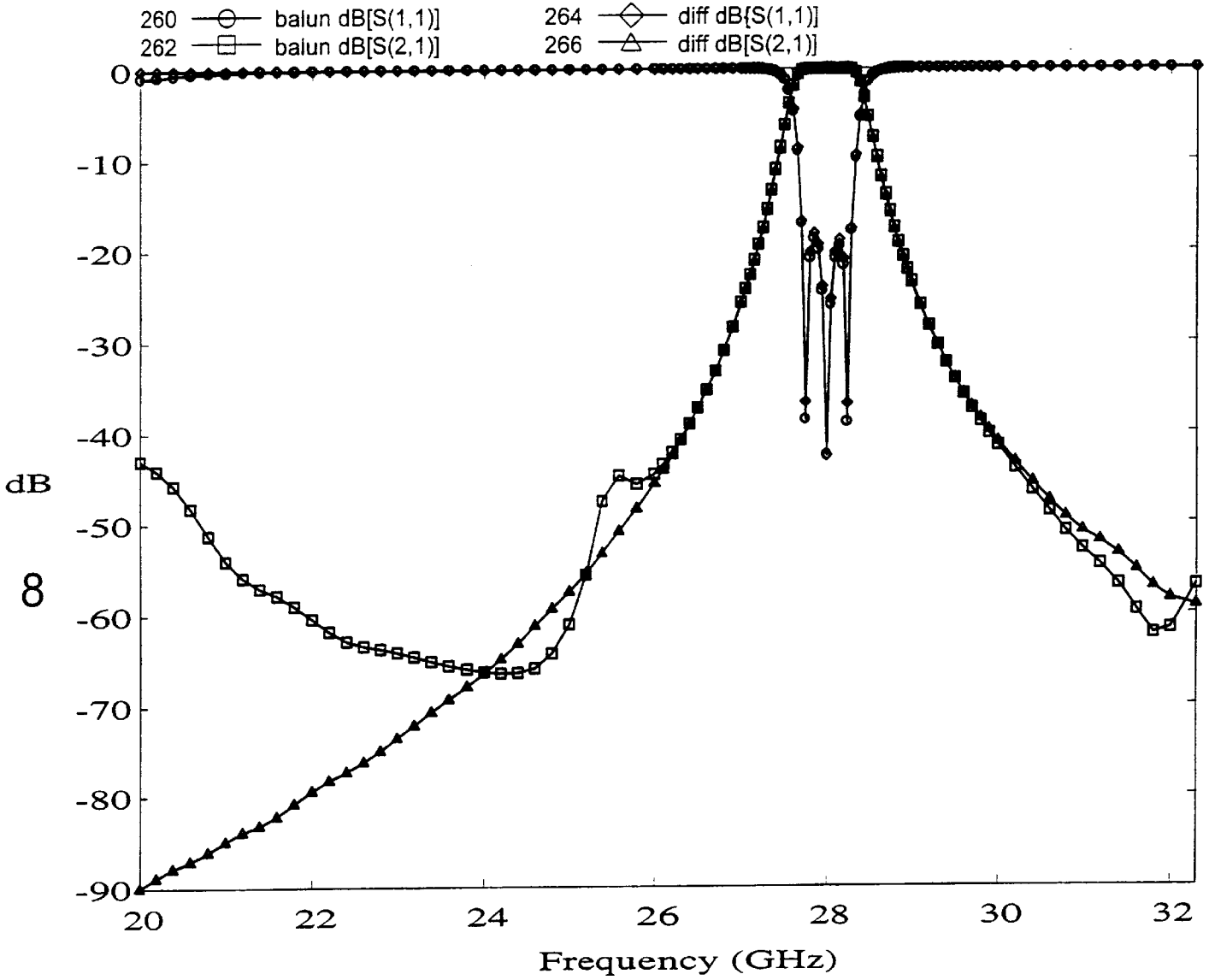
FIG. 8 is a plot comparing the performance of two balanced microstrip filters according to the invention.

It is noted that the common mode signal attenuation of the balanced microstrip filter is not particularly good, so the useful stop band of the filter is determined by the bandwidth of the microstrip to balanced microstrip transition used. The plot in FIG. 8 compares the balanced filter response when driven with a pair of lossless microstrip to balanced line transitions (curves 260,262) to that driven with a differential signal (curves 264,266). In this case, the stop band attenuation begins to seriously degrade outside an 18% bandwidth.

Conventional microstrip bandpass filters have been designed using equivalent circuit simulators which do not account for radiation losses, and these radiation losses can be quite significant, resulting in inaccurate simulation results. It appears unlikely that an equivalent circuit model for a section of a bandpass filter designed according to the invention will be developed in the future. If such an equivalent circuit model becomes available, a bandpass filter according to the invention would be able to be designed with an equivalent circuit simulator. Because the filters have very low radiation loss to begin with, the effect of neglecting radiation loss in the simulation will be very small.

It is difficult in general to give a simplified theoretical explanation of the effect upon an N-pole filter response of varying the overlap between adjacent sets of filter segments. Some explanation can be given for the case where N=1, in which the filter has two sections. In a two section design, there is a single pair of resonators coupled to an input and an output. The amount of overlap determines the Q of the filter. With more overlap, a lower Q results, and this translates into a wider frequency response. With less overlap, a higher Q results, and this translates into a narrower frequency response. Generalizations such as this have not been found for higher order bandpass filters.

Figure 9A:
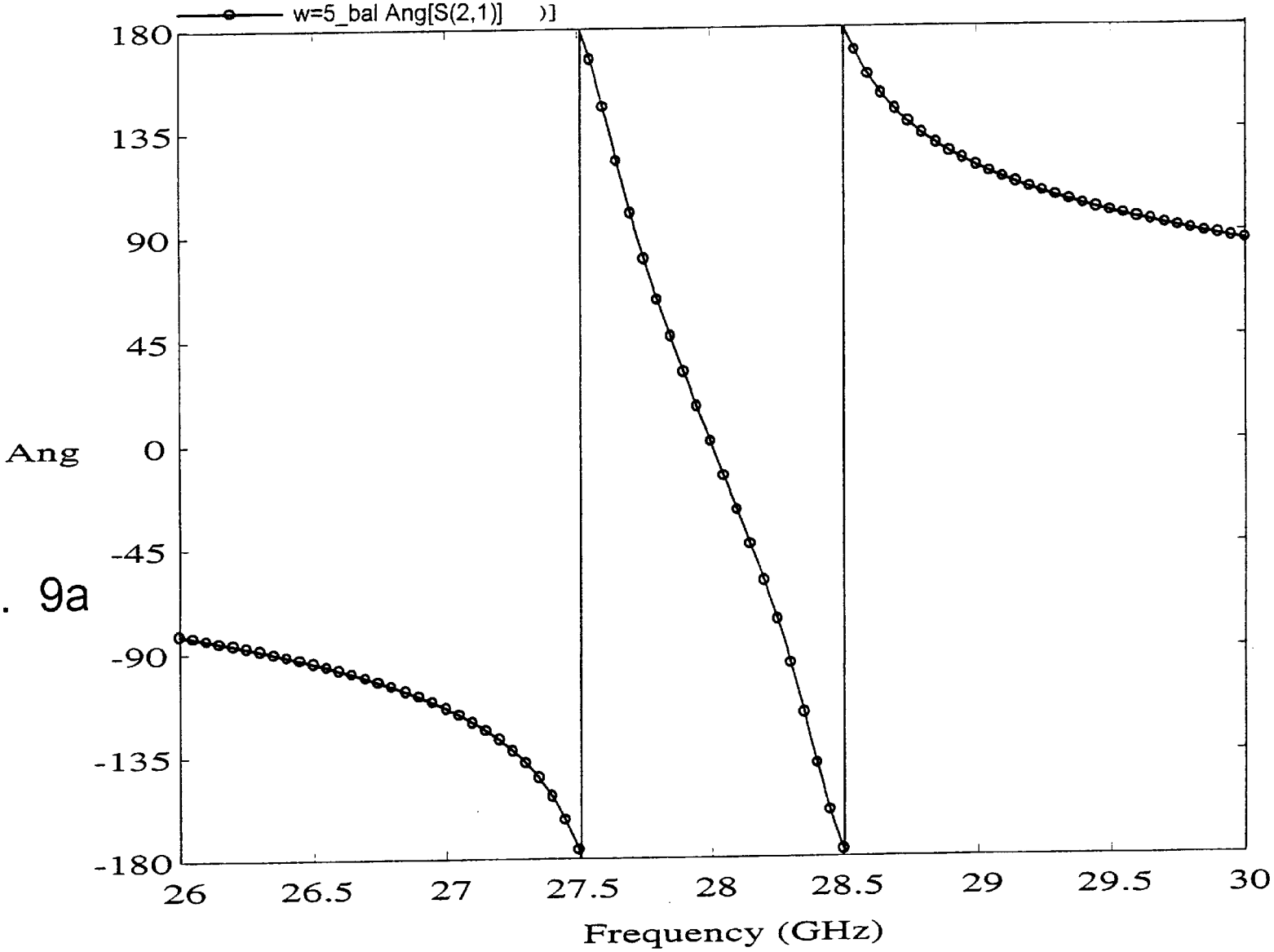
FIGS. 9*a* and 9*b* are plots of typical transmission and reflection phase response of a balanced microstrip bandpass filter according to the invention.
Figure 9B:
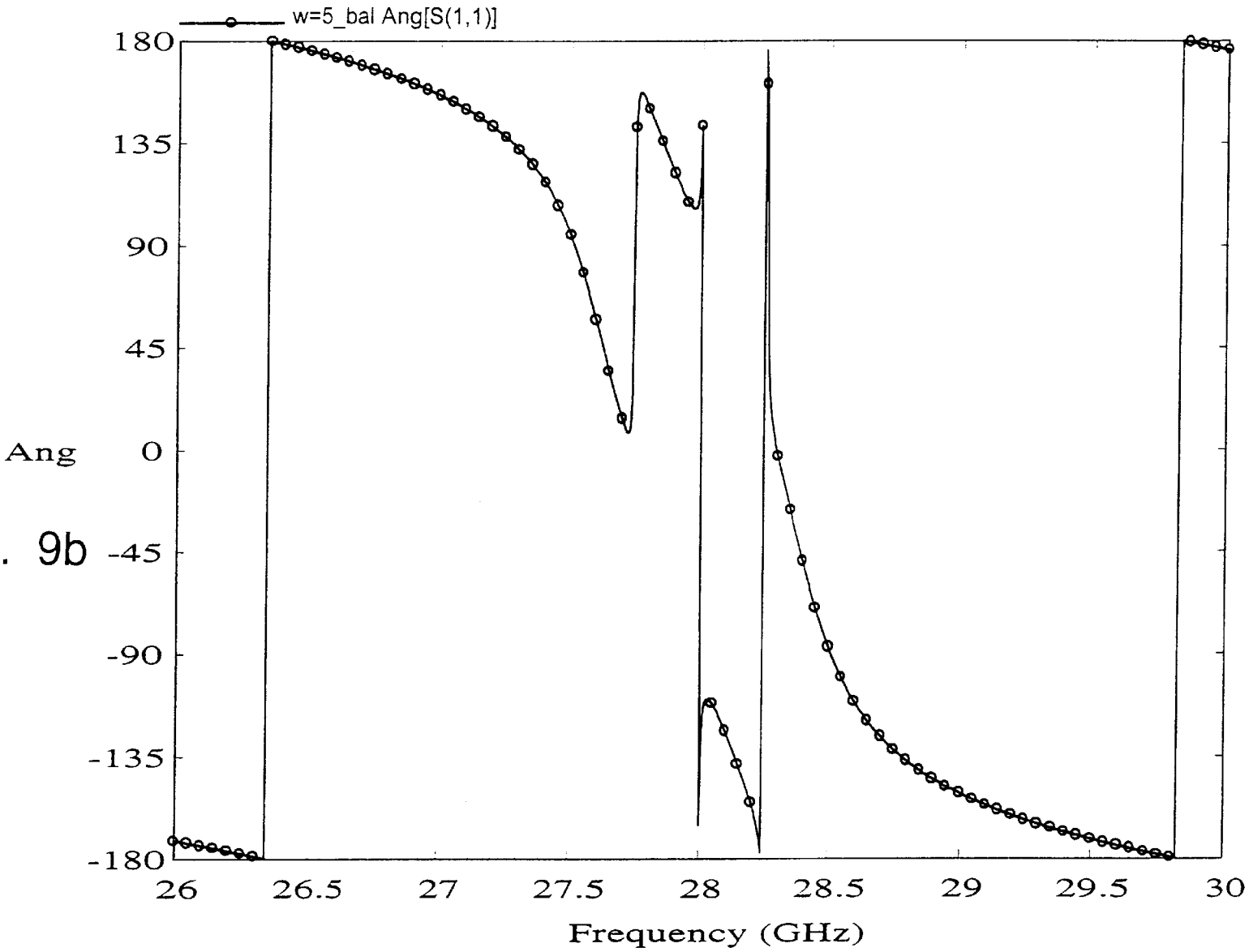

A phase response of a bandpass filter designed according to the invention is plotted in FIGS. 9*a* and 9*b* for the filter shown in FIG. 3*b*. FIG. 9*a* is a plot of the transmission phase response (the phase of $S_{21}$). The transmission phase response is continuous with an increased phase delay in the passband. FIG. 9*b* is a plot of the reflection phase response (the phase of $S_{11}$). The reflection phase response has a 180° phase shift at each pole as the reflection goes through zero. The 180° phase shift is not necessarily between −90° and 90°. Some applications exist such as the transceiver application, in which the phase behaviour of the filter is of little importance, but in other cases it is desirable to have a linear phase response across the passband. The design methods disclosed herein do not specifically address the problem of optimizing the phase response.

Figure 10A:
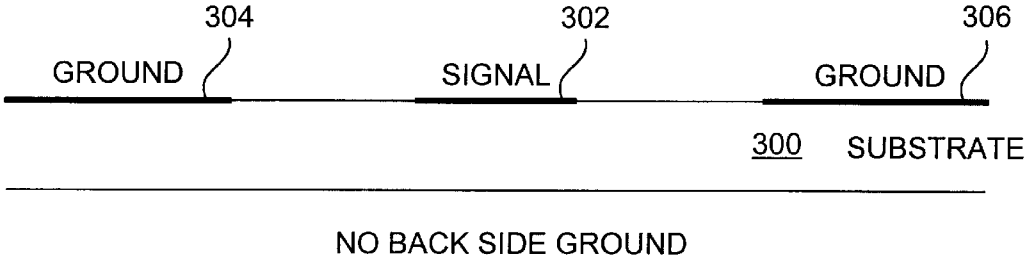
FIG. 10*a* is a sectional view of a coplanar waveguide transmission line.
Figure 10B:
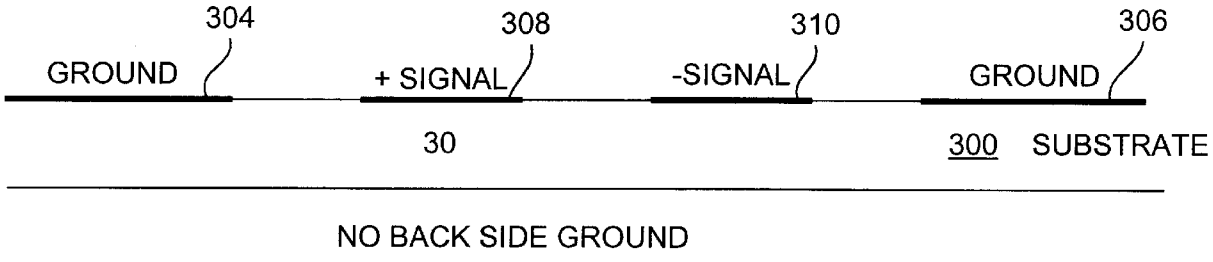
FIG. 10*b* is a sectional view of a balanced coplanar waveguide transmission line.
Figure 10C:
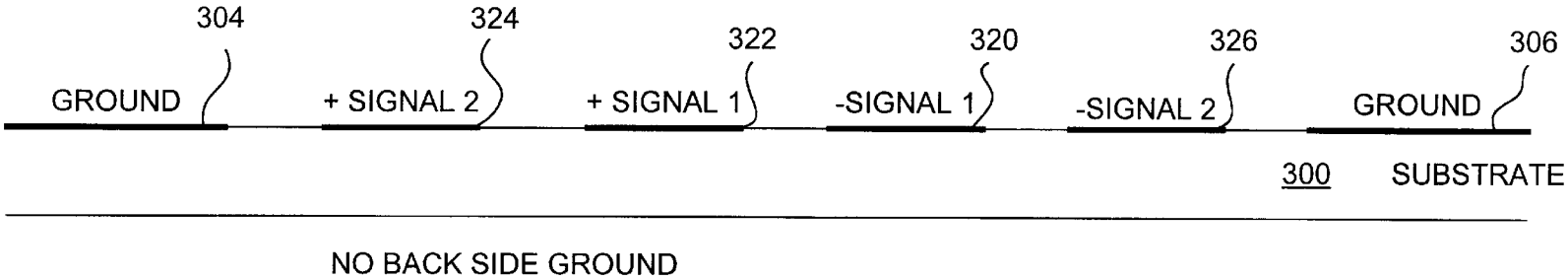
FIG. 10*c* is a sectional view of a filter section designed with balanced coplanar waveguide transmission lines.
Figure 10D:
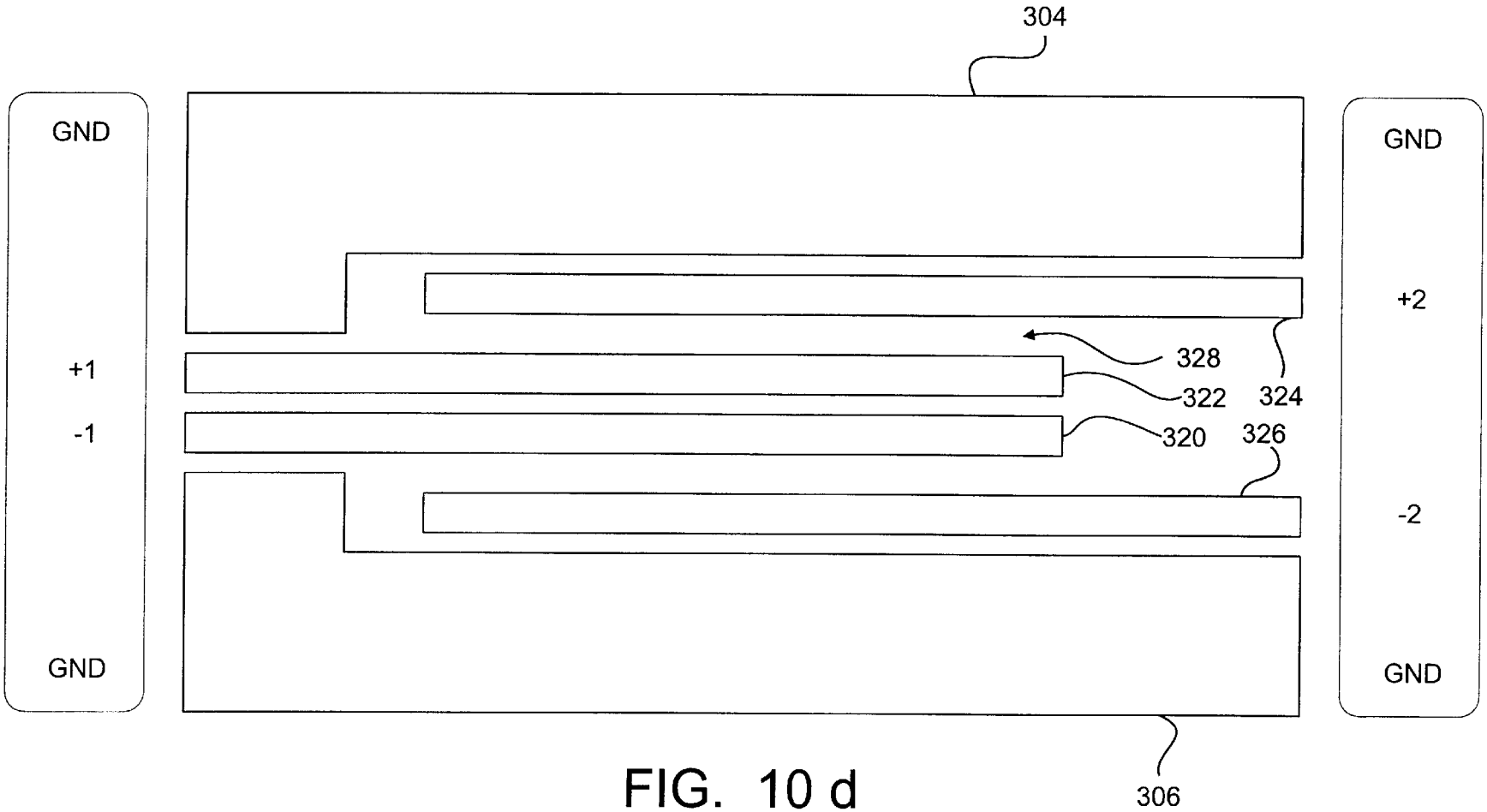
FIG. 10*d* is a plan view of the filter section of FIG. 10*c;*

A second embodiment of the invention, which is more hypothetical in nature, will be described with reference to FIGS. 10*a* to 10*d*. FIG. 10*a* shows a cross-sectional view of a conventional CPW (coplanar waveguide) transmission line consisting of a substrate 300 upon which is located a signal conductor 302. Rather than having a ground plane located beneath the substrate as in the case of a microstrip design, the CPW design features two regions of ground 304,306 on the surface of the substrate on either side of the signal conductor 302. Balanced CPW transmission lines could be realized as shown in FIG. 10*b* where two signal conductors 308,310 are used rather than the single conductor 302 of FIG. 10*a*. The balanced line of FIG. 10*b* suffers from lower radiation loss than the single sided line of FIG. 10*a*. The techniques described earlier with respect to microstrip bandpass filter designs can be applied to balanced CPW transmission lines to the same effect. FIGS. 10*c* and 10*d* illustrate an example of a filter section realized with a CPW design. Referring to FIG. 10*d* which shows a plan view, the filter section consists of a first pair of conductors 320,322 coupled to a second pair of conductors 324,326 through coupling overlap region 328. The ground regions 304,306 are shown on either side of the conductors 320,322,324,326. The design of a CPW balanced bandpass filter may be done using similar techniques to those described above for the microstrip design, although CPW models and design techniques are not as well established as those for microstrip.

Figure 11A:
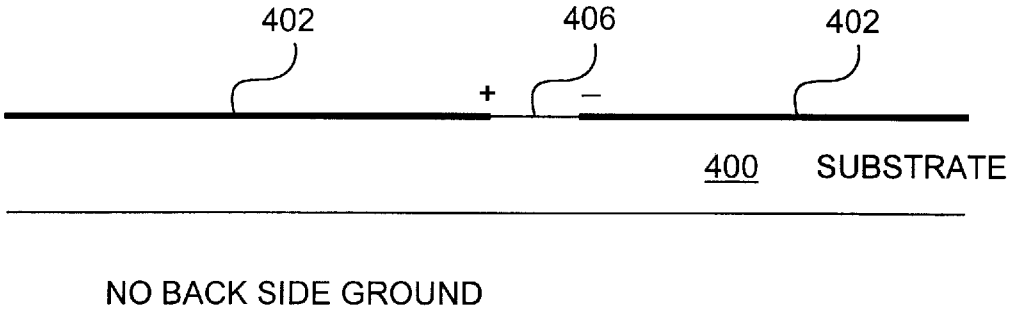
FIG. 11*a* is a sectional view of a slotline transmission line.
Figure 11B:
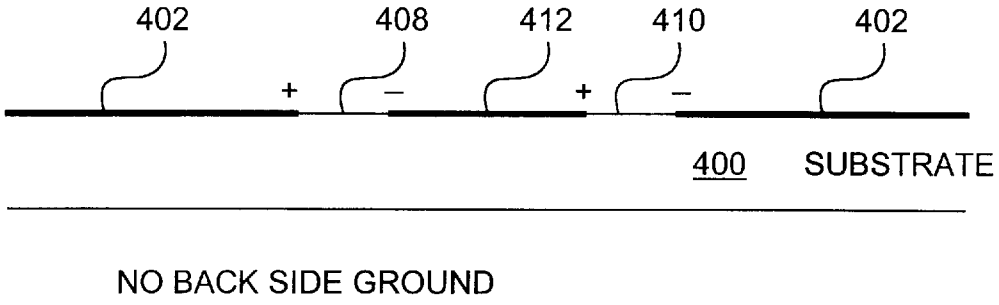
FIG. 11*b* is a sectional view of a balanced slotline transmission line.
Figure 11C:
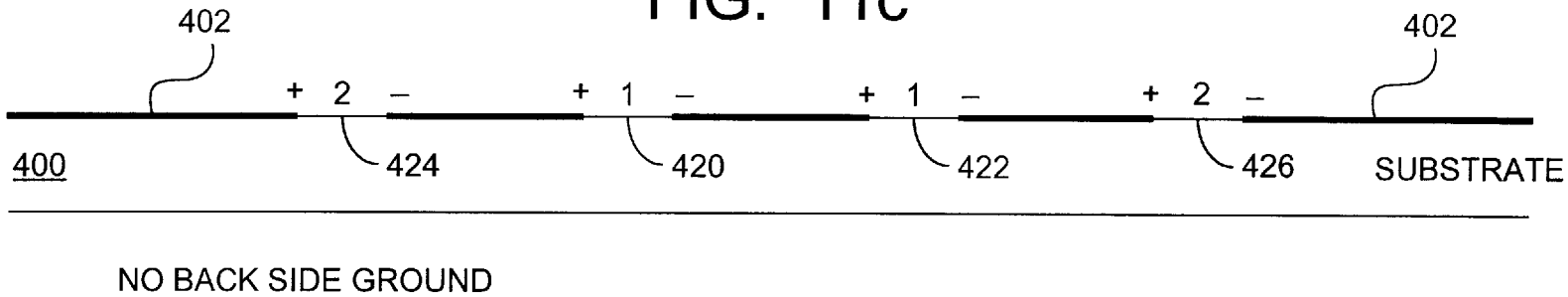
FIG. 11*c* is a sectional view of a filter section designed with balanced slotline transmission lines.
Figure 11D:
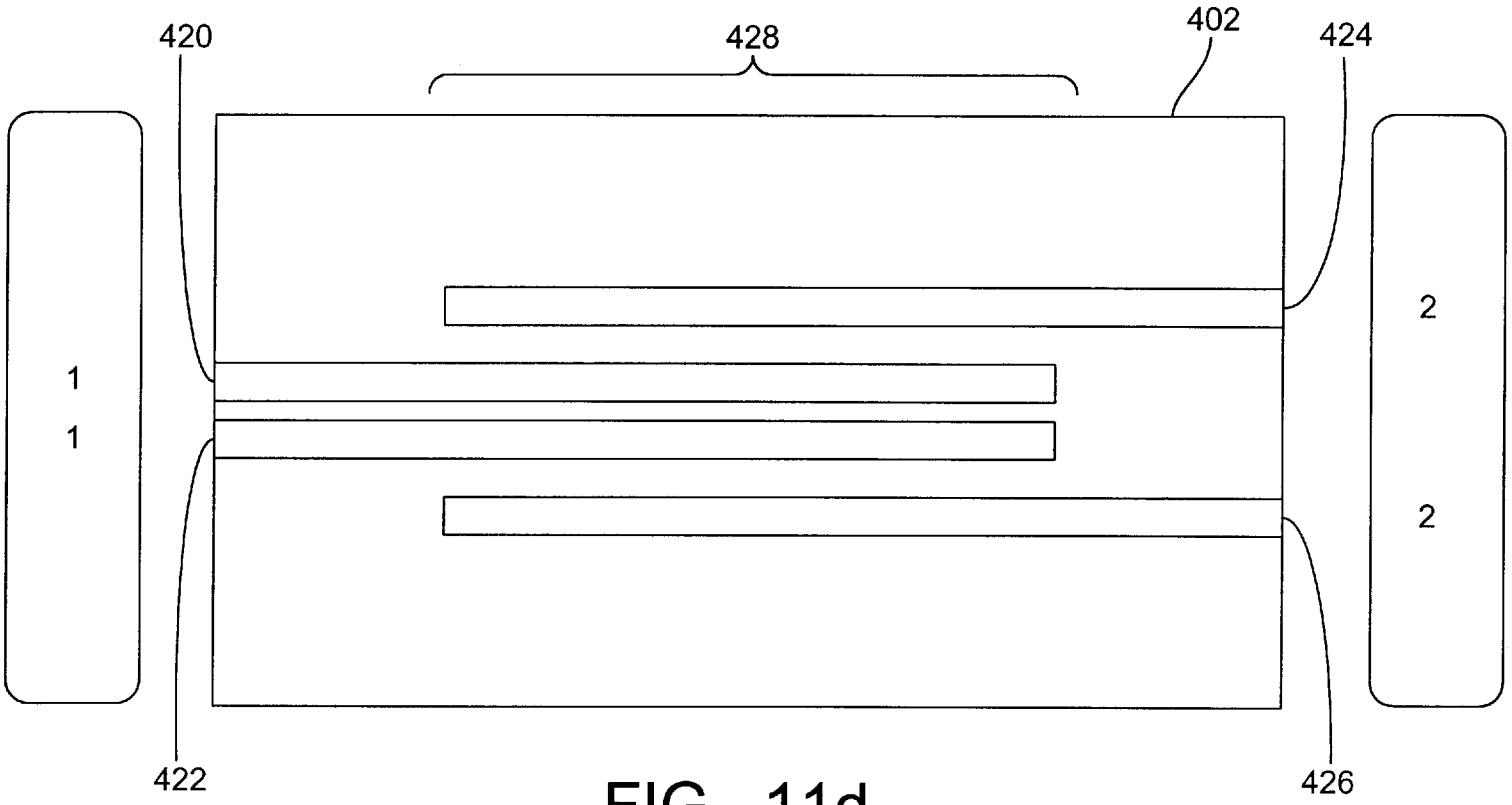
FIG. 11*d* is a plan view of the filter section of FIG. 11*c;*

A third embodiment of the invention which is also somewhat hypothetical in nature, will be described with reference to FIGS. 11*a* to 11*d*. FIG. 11*a* shows a cross-sectional view of a conventional slotline transmission line consisting of a substrate 400 upon which is located a conductor region 402 surrounding slot 406. Balanced slotline transmission lines could be realized as shown in FIG. 11*b* where two slots 408,410 on either side of centre conductor 412 are used rather than the single slot 406 of FIG. 11*a*. This is very similar to the CPW shown in FIG. 10*a*, but in this case, the centre conductor behaves like a ground. The balanced line of FIG. 11*b* suffers from lower radiation loss than the single sided line of FIG. 11*a*. The techniques described earlier with respect to microstrip bandpass filter designs can be applied to balanced slotline transmission lines to the same effect. FIGS. 11*c* and 11*d* illustrate an example of a filter section realized with a slotline design. Referring to FIG. 11*d* which shows a plan view, the filter section consists of a first pair of slots 420,422 coupled to a second pair of slots 424,426 through coupling overlap region 428. The slots 420,422,424,426 are surrounded by a contiguous conductive region 402. The design of a slotline balanced bandpass filter may be done using similar techniques to those described above for the microstrip design, although slotline models and design techniques are not as well established as those for microstrip.

Numerous modifications and variations of the present invention are possible in light of the above teachings. It is therefore to be understood that within the scope of the appended claims, the invention may be practised otherwise than as specifically described herein.

For example, in addition to Chebychev-I designs, Butterworth (maximally flat) designs can also be realized. A feature of a balanced microstrip filter is the availability of a wideband and low loss virtual ground. This allows high Q notches or zeros to be realized and possibly bandstop filters, or Chebychev-II (equiripple in the stopband) or Cauer (elliptical) bandpass filters. Also, low loss stepped impedance lowpass filters could be realized in balanced microstrip.

Figure 12:
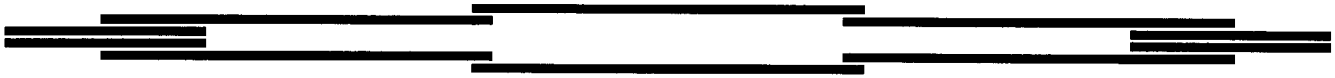
FIG. 12 is a plan view of an alternative balanced microstrip bandpass filter.

In the illustrated embodiment, the microstrip segments of adjacent pairs have alternately increasing and decreasing gaps between them. It is believed that this yields the lowest radiation loss, but alternative balanced configurations may be used. For example the gap may increase for several adjacent pairs, and then decrease for several adjacent pairs as illustrated in FIG. 12.

In the illustrated embodiment, open circuit parallel microstrip segments have been employed with the coupling between adjacent resonators or between resonators and input/output lines determined by the length of overlap. The invention is not limited to this particular type of coupling. Alternatively, end coupling, broadside coupling, or conventional parallel coupling may be employed, so long as the result is a balanced design with low radiation loss. Each of these alternatives is discussed briefly below.

Figure 13:
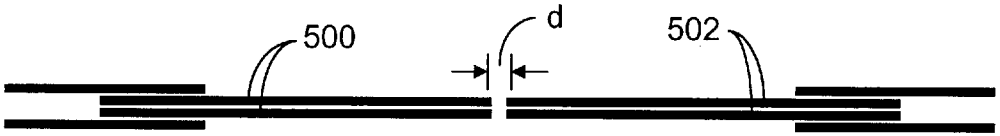
FIG. 13 is a plan view of an end coupled arrangement of microstrip segments, this is shown in FIGS. 14*a* and 14*b* where three pairs of microstrip segments 500,502,504 are shown with only one of each pair visible in the side-section view of FIG. 14*a*. Pairs 500 and 504 are in a first plane, while pair 502 is a second plane 508. The planes 506,508 are spaced a first and second distance from the ground plane 510 respectively.
Figure 14A:
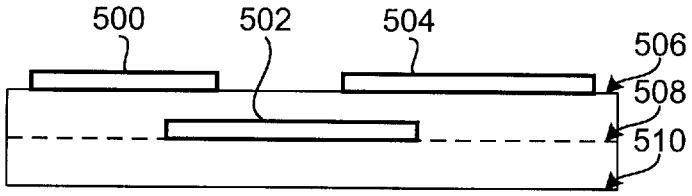
Figure 14B:
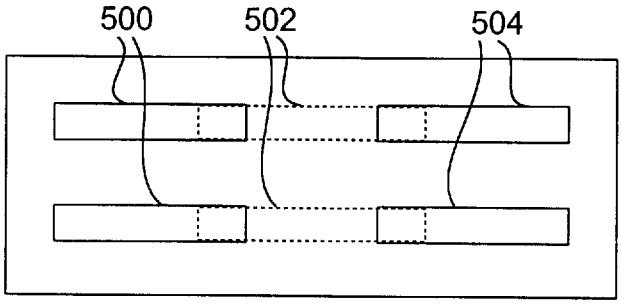

With end coupling, adjacent pairs of microstrip segments are arranged in an end-to-end relationship rather than an overlapping configuration. The amount of coupling between adjacent pairs of segments increases as the end-to-end distance decreases. An example of this is shown in FIG. 13 in which the pair of segments 500 is end coupled to pair of segments 502, the degree of coupling being a function of distance d.

With broadside coupling, adjacent pairs of microstrip segments are located in an overlapping fashion in different planes. A broadside coupled filter section is comprised of a first pair of microstrip segments located in a plane a first distance from the ground plane, and a second pair located in a plane a second distance from the ground plane such that there is a planar overlap between the two pairs of segments.

The embodiments of the invention in which an exclusive property or privilege is claimed are defined as follows:

1. A balanced microstrip bandpass filter having a centre frequency comprising:

a dielectric substrate having a bottom surface and a top surface;

a ground plane on a bottom surface of the substrate;

on the top surface of the substrate, a first pair, a last pair, and M intermediate pairs of parallel microstrip resonant segments where M is an integer $\geqq 1$;

each pair comprising two microstrip segments which are parallel, non-colinear, and coextensive with each other;

the pairs being arranged in sequence lengthwise such that each of said M intermediate pairs has an adjacent pair at each of its opposite ends with the spacing between the two microstrip segments in each of the pairs being alternately smaller and larger;

for each smaller spaced pair adjacent a larger spaced pair, a lengthwise portion of the smaller pair being disposed between the adjacent larger spaced pair;

the microstrip segments having lengths, lengthwise portions which collectively determine the frequency response of the filter;

input microstrip means for coupling a differential input signal to a first of said pairs of microstrip segments; and output microstrip segments for coupling a differential output signal to a last of said pairs of microstrip segments.

2. The microstrip filter of claim 1 wherein the input microstrip means comprises an input pair of microstrip segments coupled to the first pair of segments.

3. The microstrip filter of claim 2 wherein the input pair of microstrip segments has a length of approximately $\lambda/4$ where $\lambda$ is the wavelength of the centre frequency of the bandpass filter.

4. The microstrip filter of claim 3 wherein the input pair of microstrip segments are parallel-length coupled to the first pair of segments.

5. The microstrip filter of claim 2 wherein the input pair of microstrip segments are broadside coupled to the first pair of segments.

6. The microstrip filter of claim 3 wherein the input pair of microstrip segments are end-to-end coupled to the first pair of segments.

7. The microstrip filter of claim 1 wherein the output microstrip means comprises an output pair of microstrip segments coupled to the last pair of segments.

8. The microstrip filter of claim 7 wherein the output pair of microstrip segments has a length of approximately $\lambda/4$ where $\lambda$ is the wavelength of the centre frequency of the bandpass filter.

9. The microstrip filter of claim 8 wherein the output pair of microstrip segments are parallel-length coupled to the last pair of segments.

10. The microstrip filter of claim 7 wherein the output pair of microstrip segments are broadside coupled to the last pair of segments.

11. The microstrip filter of claim 2 wherein the input pair of microstrip segments are end-to-end coupled to the first pair of segments.

12. The microstrip filter of claim 4 wherein the output microstrip means comprises an output pair of microstrip segments coupled to the last pair of segments, the output pair of microstrip segments having a length of approximately $\lambda/4$ where $\lambda$ is the wavelength of the centre frequency of the bandpass filter, the output pair of microstrip segments being parallel-length coupled to the last pair of segments.

13. The microstrip filter of claim 1 wherein the M pairs of microstrip segments each have a length of approximately $\lambda/2$.

14. The microstrip filter of claim 12 wherein the M pairs of microstrip segments each have a length of approximately $\lambda/2$.

15. A microstrip bandpass filter having a centre frequency comprising:

a dielectric substrate;

a ground plane on a first surface of the substrate;

N pairs of parallel microstrip resonant segments where N is an integer$\geqq$2 including a first pair of microstrip segments and a last pair of microstrip segments, the parallel microstrip segments of a given pair being substantially coextensive, each pair located a spaced distance from the first surface, the N pairs of microstrip segments arranged in sequence lengthwise with each pair of segments coupled to any adjacent pairs of microstrip segments;

input microstrip means for coupling an input line to the first pair of microstrip segments, and output microstrip means for coupling an output line to the last pair of microstrip segments;

wherein the input microstrip means comprises a first transition for connecting the filter to a single ended microstrip input, the first transition comprising:

a "T" junction for connection to the input;

a pair of microstrip corner junctions for connection to the first pair of microstrips;

a first microstrip segment approximately $\lambda/4$ long connecting the "T" junction and one of the corner junctions and a second microstrip segment approximately $3\lambda/4$ long connecting the "T" junction and the other of the corner junctions, where $\lambda$ is the wavelength of the centre frequency of the filter.

16. The microstrip filter according to claim 15 wherein the output means comprises a second transition for connecting the last pair of microstrip segments in the filter to a single ended output microstrip, the second transition comprising a "T" junction for connection to the output;

a pair of microstrip corner junctions for connection to the last pair of microstrips;

a first microstrip segment approximately $\lambda/4$ long connecting the "T" junction and one of the corner junctions and a second microstrip segment approximately $3\lambda/4$ long connecting the "T" junction and the other of the corner junctions, where $\lambda$ is the wavelength of the centre frequency of the filter.

17. A slotline bandpass filter having a centre frequency comprising:

a dielectric substrate having a surface;

a conductive plane on the surface with N pairs of parallel balanced resonant slots therein where N is an integer$\geqq$2 including a first pair of slots and a last pair of slots, the N pairs of parallel slots each being coextensive and arranged in sequence lengthwise with each pair of slots coupled to any adjacent pairs of slots;

input means for coupling an input line to the first pair of slots; and output means for coupling an output line to the last pair of slots.

18. A balanced microstrip bandpass filter having a centre frequency comprising:

a dielectric substrate having a bottom surface;

a ground plane on a bottom surface of the substrate;

alternating between two planes in or on said substrate which are both parallel to the bottom surface, a first pair, a last pair, and M intermediate pairs of parallel microstrip resonant segments where M is an integer$\geqq$1;

each pair comprising two microstrip segments which are parallel, non-colinear, and coextensive with each other;

the pairs being arranged in sequence lengthwise such that each of said M intermediate pairs has an adjacent pair in the other of the two planes at each of its opposite ends;

a lengthwise portion of each pair in the first plane being broadside coupled to any adjacent pairs in the second plane;

the microstrip segments having lengths, and lengthwise portions which collectively determine the frequency response of the filter;

input microstrip means for coupling a differential input signal to a first of said pairs of microstrip segments; and output microstrip segments for coupling a differential output signal to a last of said pairs of microstrip segments.

19. A CPW (coplanar waveguide) bandpass filter having a centre frequency comprising:

a dielectric substrate having a surface;

on the surface of the substrate, a first pair, a last pair, and M intermediate pairs of parallel balanced CPW conductor segments, where M is an integer$\geqq$1;

each pair comprising CPW segments which are parallel, non-colinear, and coextensive with each other;

the pairs being arranged in sequence lengthwise such that each of said M intermediate pairs has an adjacent pair at each of its opposite ends with the spacing between the two CPW segments in each of the pairs being alternately smaller and larger;

for each smaller spaced pair adjacent a larger spaced pair, a lengthwise portion of the smaller pair being disposed between the adjacent larger spaced pair;

the CPW segments having lengths, lengthwise overlap portions which collectively determine the frequency response of the filter;

ground regions on either side of the CPW conductor segments;

input means for coupling a differential input line to the first pair of CPW segments; and output means for coupling a differential output line to the last pair of CPW segments.

* * * * *